US005941174A

United States Patent [19]

Rodet

[11] Patent Number: 5,941,174

[45] Date of Patent: Aug. 24, 1999

[54] MOTORIZED AXLE HAVING WHEELS THAT ROTATE INDEPENDENTLY

[75] Inventor: Alain Rodet, Le Creusot, France

[73] Assignee: GEC Alsthom Transport SA, Paris, France

[21] Appl. No.: 08/864,761

[22] Filed: May 29, 1997

[30] Foreign Application Priority Data

May 29, 1996 [FR] France ..... 96 06589

[51] Int. Cl.[6] ..... B61C 9/00

[52] U.S. Cl. ..... 105/96; 105/131; 105/133; 105/199.1

[58] Field of Search ..... 105/96, 98, 117, 105/131, 132, 133, 140, 199.1

[56] References Cited

U.S. PATENT DOCUMENTS

| | | | |
|---|---|---|---|
| 2,766,703 | 10/1956 | Cooke | 105/96 |
| 3,523,505 | 8/1970 | Lich | 105/133 |
| 3,913,495 | 10/1975 | Pelabon | 105/199.2 |
| 4,913,060 | 4/1990 | Sekine et al. | 105/96 |
| 5,119,736 | 6/1992 | Chiodi | 105/133 |

FOREIGN PATENT DOCUMENTS

| | | |
|---|---|---|
| 0043340A1 | 1/1982 | European Pat. Off. . |
| 2102358 | 2/1983 | United Kingdom . |

*Primary Examiner*—S. Joseph Morano
*Attorney, Agent, or Firm*—Sughrue, Mion, Zinn, Macpeak & Seas, PLLC

[57] ABSTRACT

The present invention relates to an axle, or a pair of axles forming a bogie, motorized and having wheels that rotate independently, which axle is connected to a body or a corridor connection of a vehicle either via a load-bearing cross-member, or directly via the suspension systems, the wheels of the axle being mounted to rotate independently, wherein the entire set of members that transmit motion between the motor(s) and the wheels is disposed in a load-bearing axle assembly referred to as a "stepdown gear assembly" which simultaneously performs the functions of bearing the load, of driving the axle, and of transmitting the motor torque, wherein the motor or each of the motors has its axis parallel to the axis of the axle, and wherein a large amount of modularity exists between the single-motor version and the one-motor-per-wheel version.

29 Claims, 9 Drawing Sheets

MOTORIZED AXLE HAVING WHEELS THAT ROTATE INDEPENDENTLY

The present invention relates to a motorized axle or to a pair of motorized axles, in particular for a rail vehicle, each axle being connected to the body or to the corridor connection of the vehicle either via a loadbearing cross-member or directly via the suspension systems, and having wheels that rotate independently.

BACKGROUND OF THE INVENTION

Known axles enable their wheels to rotate independently either:

- by means of a single electric motor ("single-motor" axle) by using a mechanical differential and a bevel gear set both of which are mounted in a stepdown gear assembly; or
- with one electric motor per wheel ("two-motor" axle).

The first solution makes use of a bevel gear set stepdown gear assembly taken from the technology applied to heavy goods vehicles. That solution offers the advantage of grouping together in a single member (the back axle assembly) all of the transmission members (gears) together with the load-bearing structure of the axle, thereby enabling the traditional solid shaft to be omitted.

As a result of the bevel gear set, such a solution suffers from the major drawback of installing the motor perpendicularly to the axis of the axle with a large amount of overhang.

The motor is then supported by a frame, equivalent to a bogie underframe, and is isolated from stresses coming from the track by interposing a suspension stage equivalent to a primary suspension between said frame and the axle assembly. That overhang adversely affects the compactness and the general balance of the axle.

The second solution uses a motor and a stepdown gear for each wheel. By placing each drive-and-gearbox unit on either side of axis of the axle, that solution offers the advantage of eliminating the overhang of the single motor in the above configuration, and thus of procuring a balanced assembly.

Unfortunately the second solution no longer enables the transmission members (gears) to be integrated into a single member (the axle assembly) together with the load-bearing structure of the axle.

The second solution thus does not enable the traditional solid shaft to be omitted, and, given the space taken up by the motors and the stepdown gears placed between the wheels, it makes it necessary to position the suspension systems outside said wheels and therefore requires a braking system using fast disks or shoes on the driving shafts.

Thus, with known solutions, the choice of the type of axle motorization (single-motor or two-motor) results in opting between two significantly different architectures without the chosen architecture being able to enjoy the cumulative advantages of both of the types.

OBJECTS AND SUMMARY OF THE INVENTION

An object of the invention is to provide a motorized axle having wheels that rotate independently, and having a design that makes it possible, with a common modular architecture, to opt equally well either for a single-motor transmission or for a two a-motor transmission, thereby offering the two main advantages specific to these two versions, namely:

- use of a stepdown gear assembly enabling the traditional solid shaft to be omitted; and

- an architecture that is compact and balanced around the axis of the axle.

In the motorized axle of the invention having wheels that rotate independently, the entire set of members that transmit motion between the motor(s) and the wheels is disposed in a load-bearing axle assembly referred to as a "stepdown gear assembly" which simultaneously performs the functions of bearing the load, of driving the axle, and of transmitting the motor torque, the motor or each of the motors has its axis parallel to the axis of the axle, and a large amount of modularity exists between the single-motor version and the one-motor-per-wheel or two-motor version.

The motorized axle of the invention having wheels that rotate independently also satisfies at least one of the following characteristics:

- the motors are rigidly mounted on the axle assembly or they are mounted to float relative thereto;
- motion is transmitted between motor and wheel via two separate stepdown gears;
- the link between motor and first stepdown gear is implemented:
  - via a link with no relative displacement when the motor is rigidly mounted; and
  - via a coupling which accommodates displacements when the motor is a floating motor;
- the mechanical link between the two stepdown gears is provided for each wheel by a "wheel shaft" whose axis coincides with the axis of the wheel;
- the link between wheel shaft and wheel is implemented for each wheel by means of the second stepdown gear having a plane or conical epicyclic gear train;
- the non-rotary axle shaft and the axle frame are implemented by the stepdown gear assembly on which the suspension rests;
- the suspension of the axle is implemented by a single stage only by means of two pneumatic cushions or metal springs, or rubber-metal springs;
- the suspension of the axle can accommodate angular displacements relative to the body or the corridor connection of the vehicle, thereby making it possible to omit the load-bearing cross-member and the ball-bearing ring;
- braking is provided by disks on the axle or on the driving shafts;
- the suspension members and the braking members are disposed between the wheels, thereby making it possible to remove any resilient tires without removing other members;
- when the brake disks are on the axle, said brake disks may be in two portions so as to facilitate removal;
- the drive, the anti-galloping, and the angular positioning of the axle relative to the body or the corridor connection of the vehicle are implemented by a linkage comprising longitudinal links; and
- roll relative to the body or the corridor connection of the vehicle is prevented by an anti-roll bar.

An advantage of the axle of the invention is that its modular architecture makes it possible for the wheels to rotate independently either with a single electric motor and mechanical differential, or with one electric motor per wheel.

BRIEF DESCRIPTION OF THE DRAWINGS

Other objects, characteristics, and advantages of the invention appear on reading the following description of preferred embodiments of motorized axles, given with reference to the accompanying drawings, in which.

DETAILED DESCRIPTION

Figure 1:
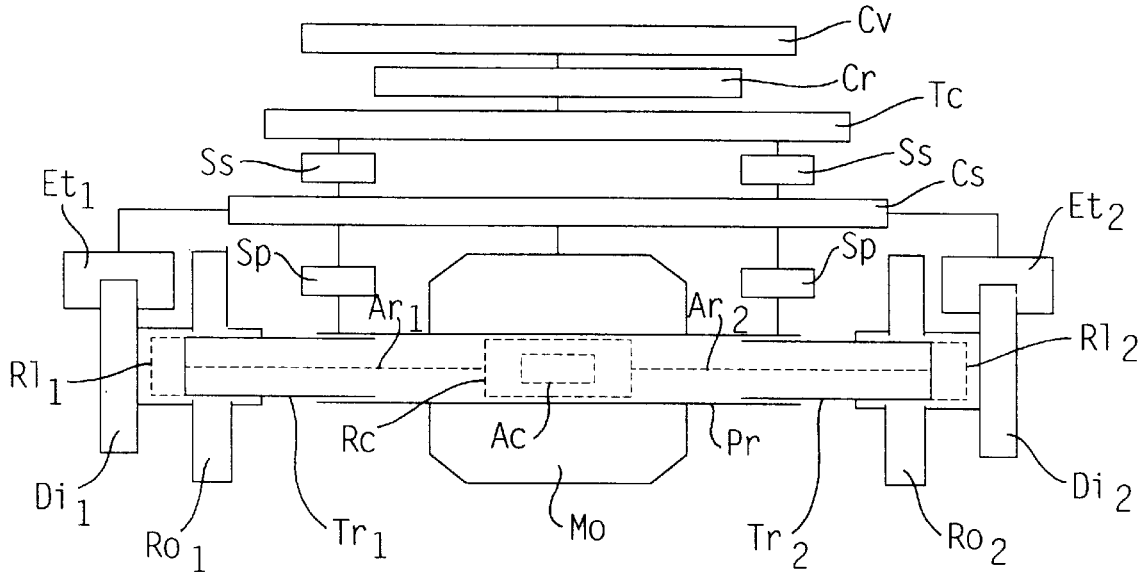
FIG. 1 PRIOR ART
FIGS. 1 and 2 diagrammatically show a single-motor motorized axle of the state of the art.
Figure 2:
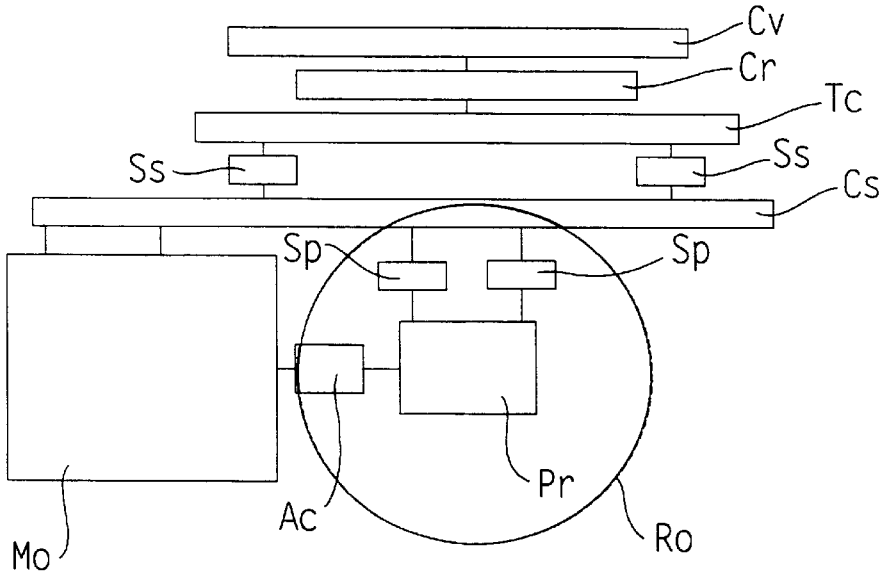
FIG. 2 PRIOR ART

FIGS. 1 and 2 diagrammatically show a single-motor motorized axle of the state of the art.

In such a known single-motor motorized axle, the body Cv of the vehicle rests via a ball-bearing ring Cr on the load-bearing cross-member Tc. Said cross-member bears on the underframe Cs via the secondary suspension Ss placed between the wheels. The underframe Cs itself bears, via the primary suspension Sp, on the differential stepdown gear assembly Pr forming the axle. Two flared axle tubes $Tr_1$ and $Tr_2$ about which the wheels $Ro_1$ and $Ro_2$ rotate are secured in the assembly Pr. The brake disks $Di_1$ and $Di_2$ are mounted on the wheels $Ro_1$ and $Ro_2$ and they are associated with the brake calipers $Et_1$ and $Et_2$ secured to the underframe Cs.

The motor Mo fixed to the underframe Cs drives the bevel gear set of the differential central stepdown gear Rc of the stepdown gear assembly Pr via a coupling Ac which accommodates the displacements due to the primary suspension Sp. Each outlet of the differential central gear Rc transmits the torque to a respective one of the side stepdown gears $Rl_1$ and $Rl_2$ via the wheel shafts $Ar_1$ and $Ar_2$.

Figure 3:
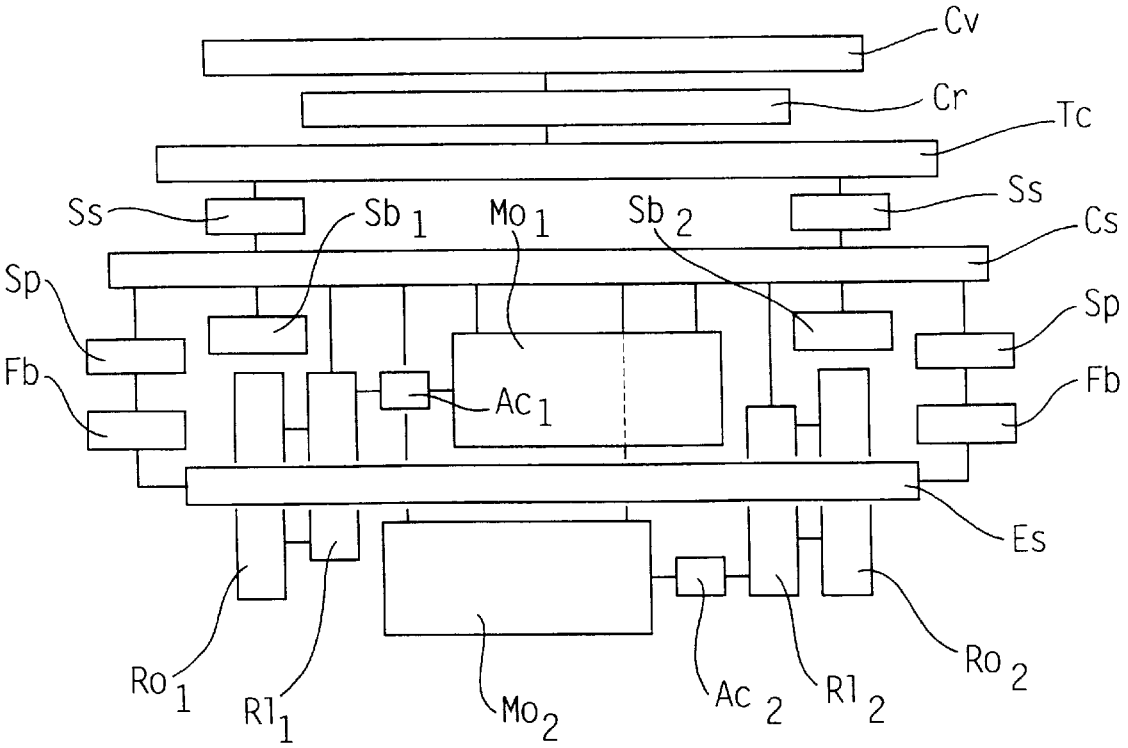
FIG. 3 PRIOR ART
FIG. 3 diagrammatically shows a two-motor motorized axle of the state of the art.
Figure 4:
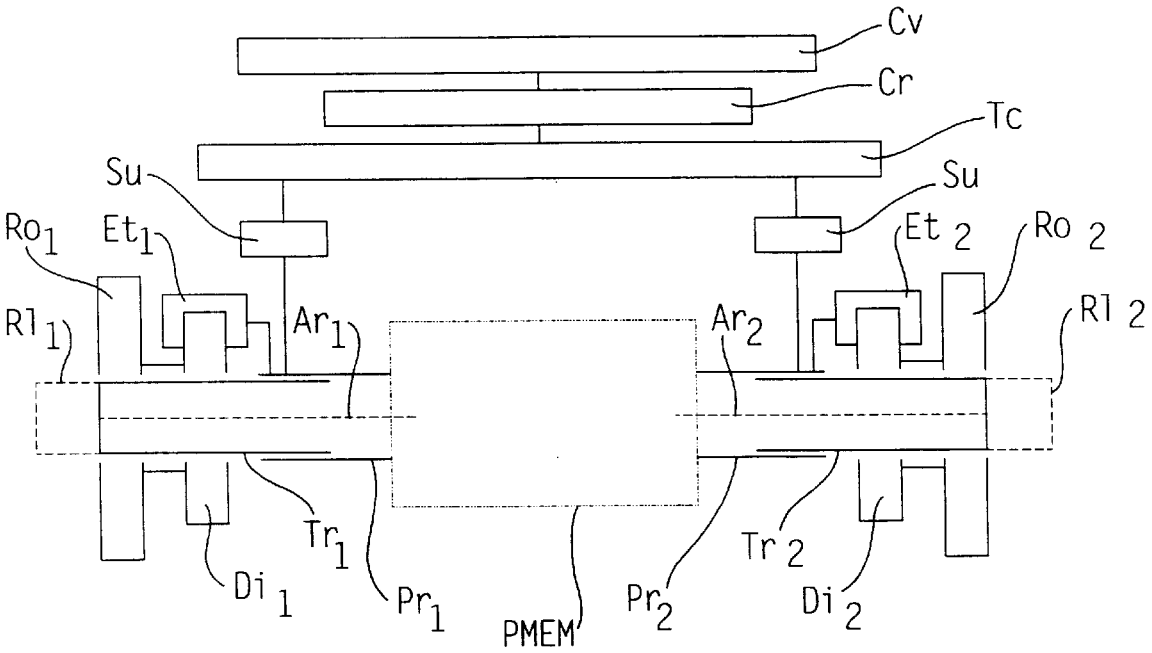
FIGS. 4 to 8 diagrammatically show single-motor or two-motor motorized axles of the invention.
Figure 5:
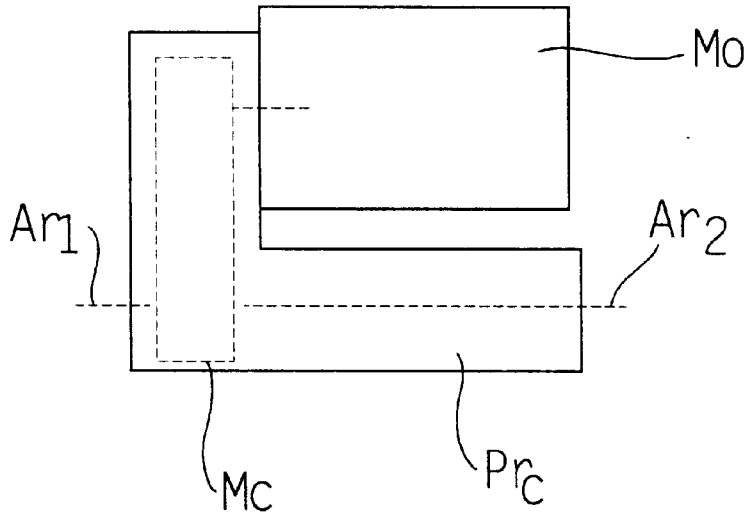
Figure 6:
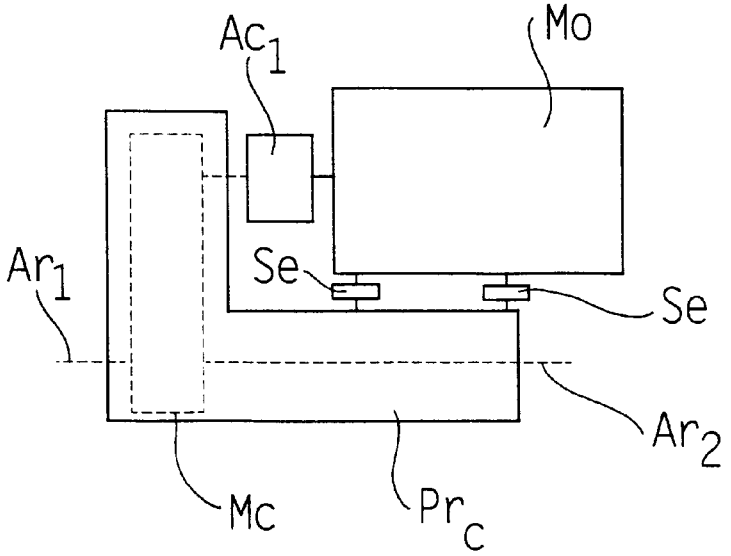
Figure 7:
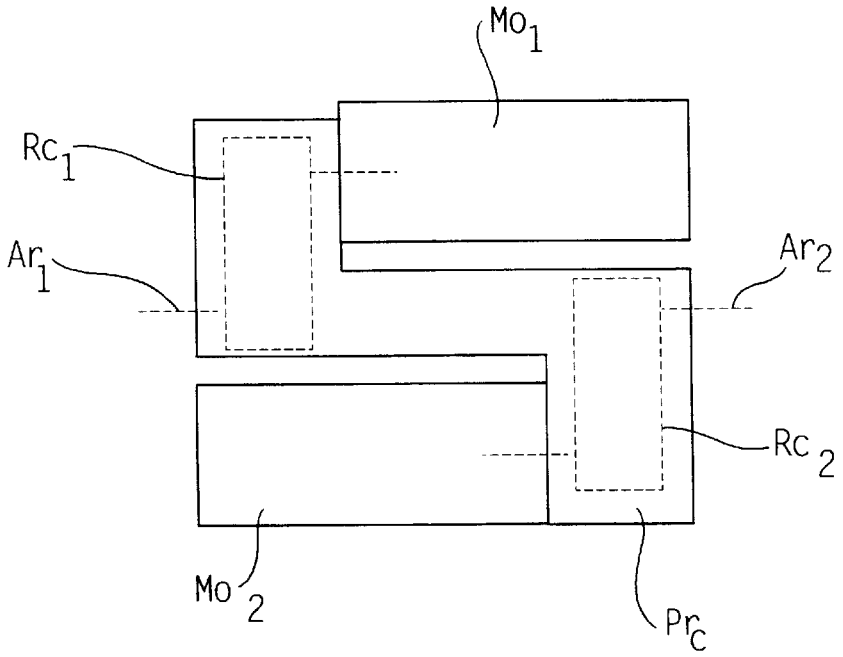
Figure 8:
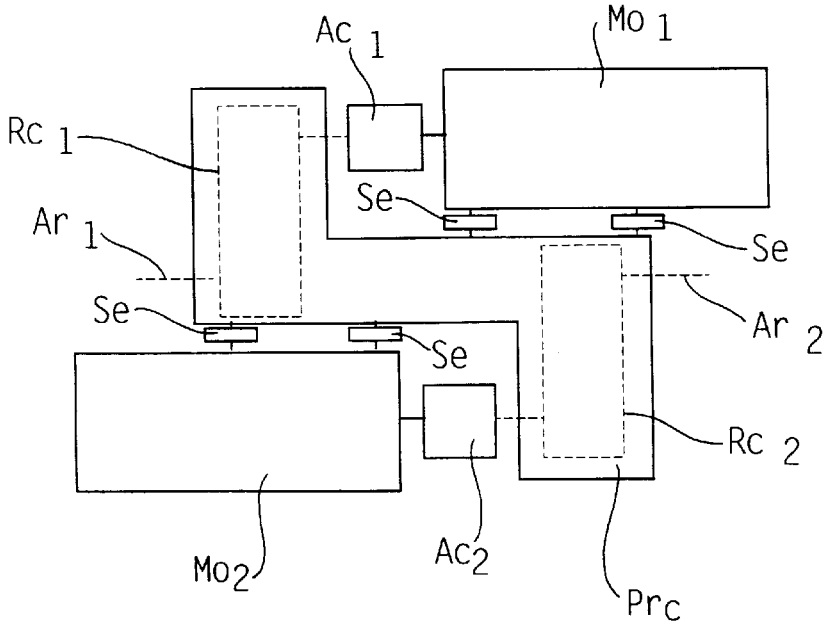

FIG. 3 diagrammatically shows a two-motor motorized axle of the state of the art.

In such a known two-motor motorized axle, the body Cv of the vehicle rests via a ball-bearing ring Cr on the load-bearing cross-member Tc. Said cross-member bears on the underframe Cs via the secondary suspension Ss. The underframe Cs itself bears on the dummy axle-boxes Fb via the primary suspension Sp placed outside the wheels. Said dummy axle-boxes are secured to the non-rotary axle Es about which the wheels $Ro_1$ and $Ro_2$ rotate. Brake shoes $Sb_1$ and $Sb_2$ secured to the underframe Cs are applied against the wheels $Ro_1$ and $Ro_2$.

Each motor Mo fixed to the underframe Cs drives the side stepdown gear Rl that is associated with it via a coupling Ac which accommodates the displacements due to the primary suspension Sp. Each side gear Rl, which is semi-suspended on the underframe Cs, drives the wheel Ro that is associated with it.

FIGS. 4 to 8 diagrammatically show single-motor or two-motor motorized axles of the invention.

Figure 9:
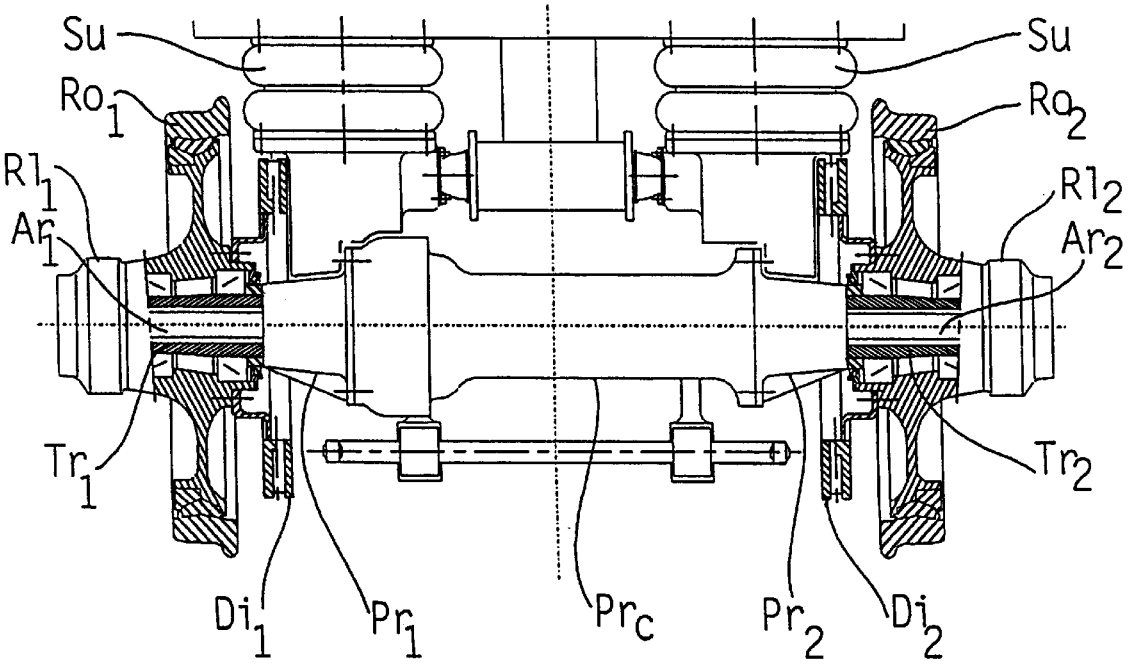
FIG. 9 is a front view of the single-motor motorized axle of the invention.
Figure 10:
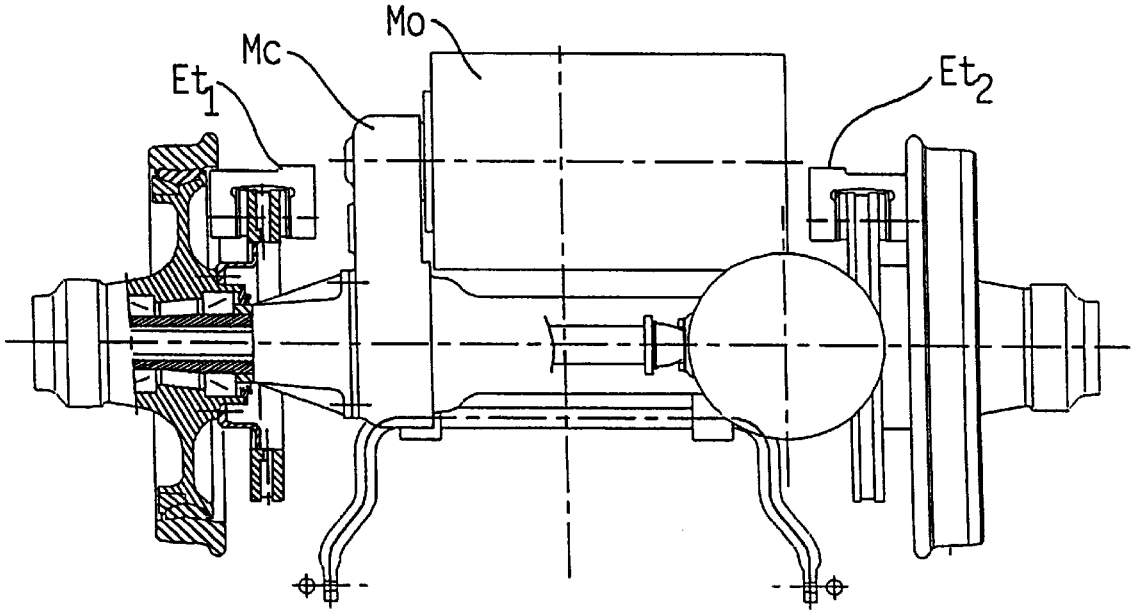
FIGS. 10 and 11 are plan views of the single-motor motorized axle of FIG. 9 shown as provided respectively with a non-suspended rigidly mounted motor, and with a suspended floating motor.
Figure 11:
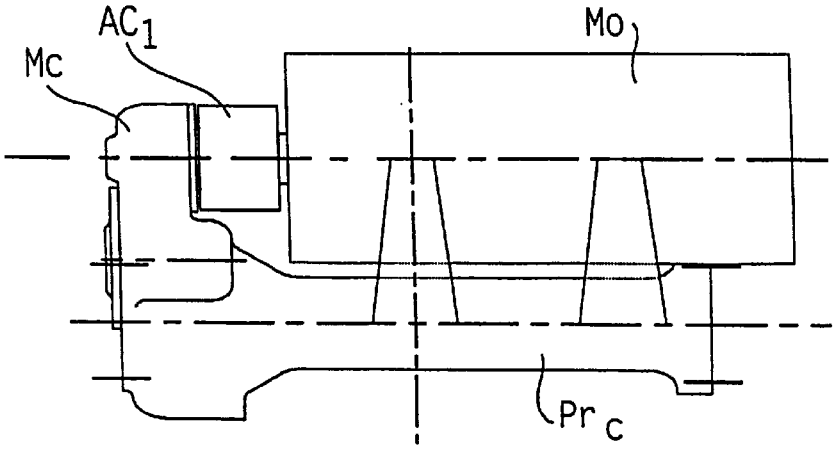

FIG. 9 is a front view of the single-motor motorized axle of the invention, and FIGS. 10 and 11 are plan views of this single-motor motorized axle, shown as provided respectively with a non-suspended rigidly mounted motor, and with a suspended floating motor.

Figure 12:
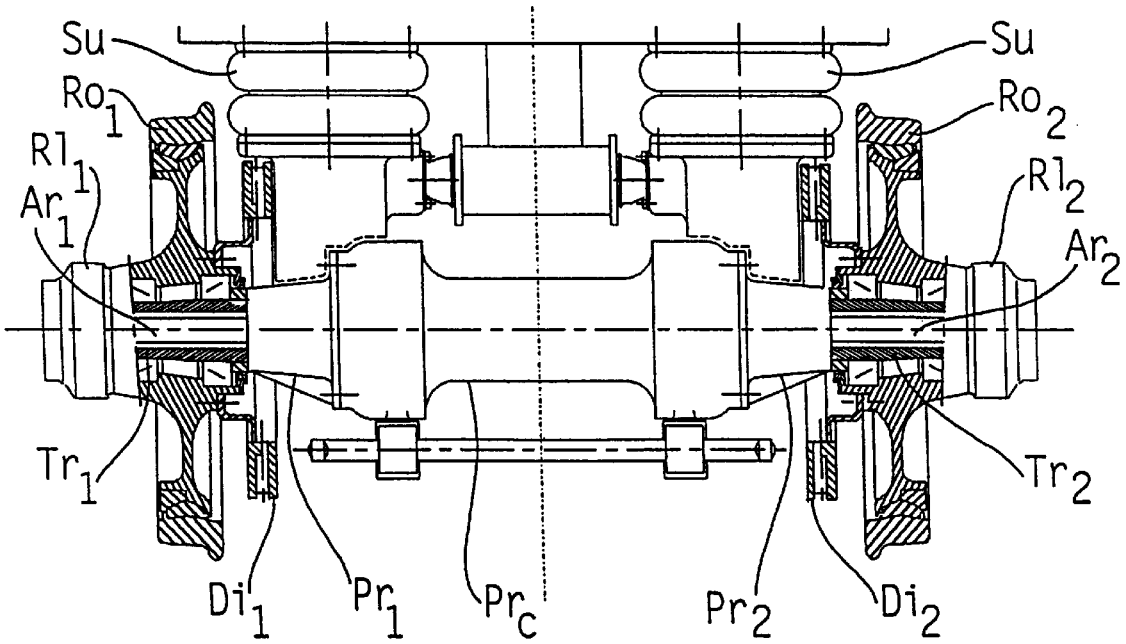
FIG. 12 is a front view of the two-motor motorized axle of the invention.
Figure 13:
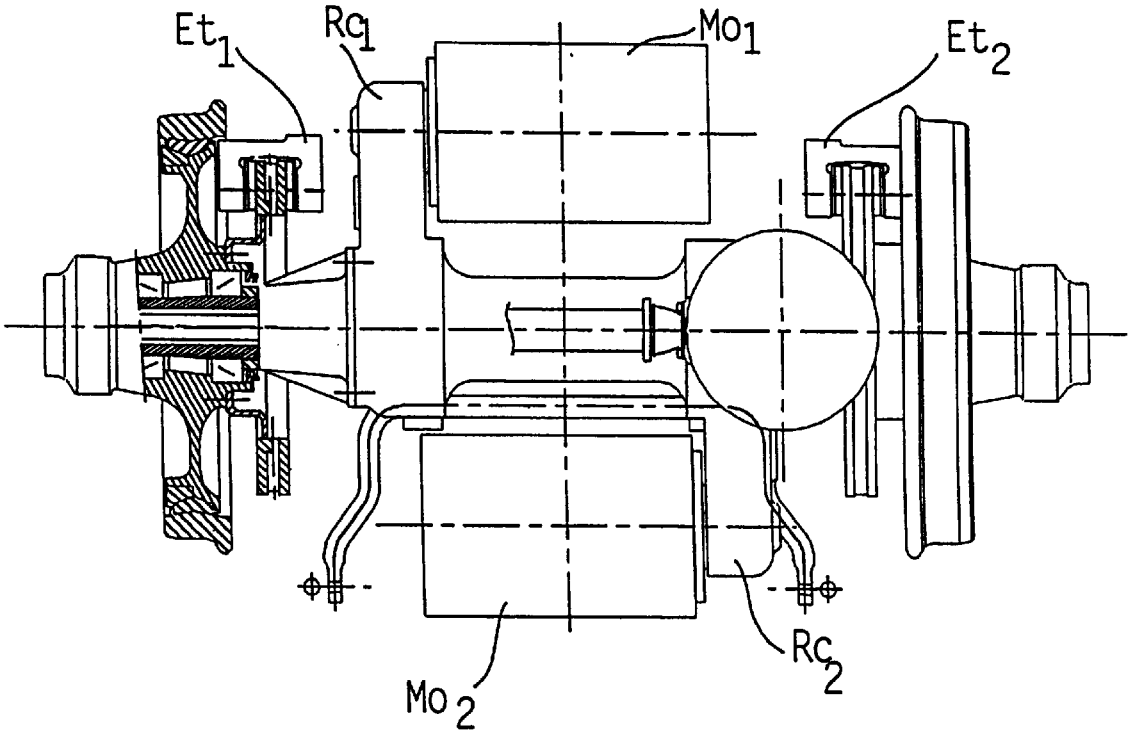
FIGS. 13 and 14 are plan views of the two-motor motorized axle of FIG. 12 shown as provided respectively with non-suspended rigidly mounted motors, and with suspended floating motors.
Figure 14:
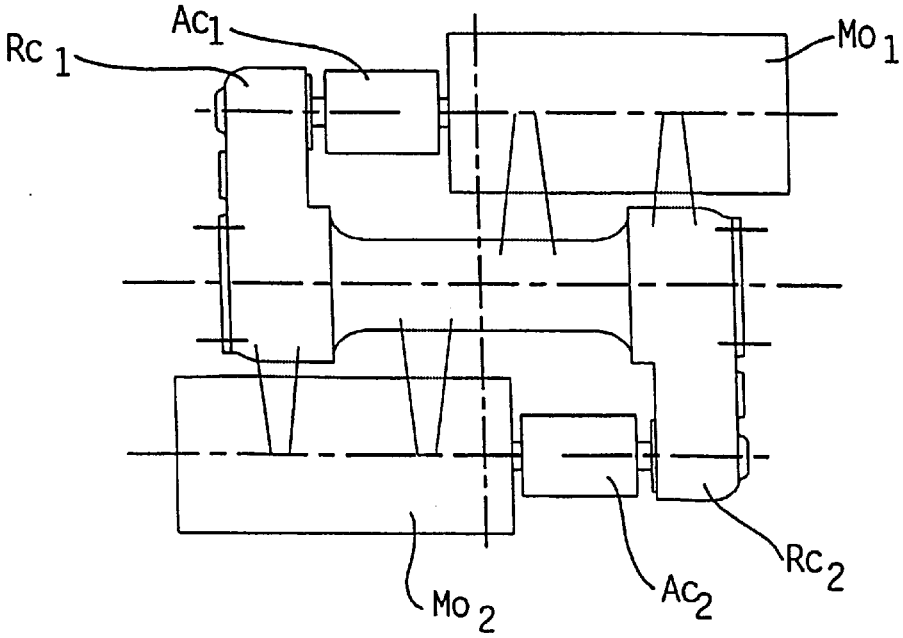

FIG. 12 is a front view of the two-motor motorized axle of the invention, and FIGS. 13 and 14 are plan views of this two-motor motorized axle, shown as provided respectively with non-suspended rigidly mounted motors, and with suspended floating motors.

In the single-motor or two-motor motorized axles of the invention, the body Cv of the vehicle rests via a ball-bearing ring Cr on the load-bearing cross-member Tc. Said cross-member bears, via the suspension Su placed between the wheels and vertical to the axle axis, on the side casings $Pr_1$ and $Pr_2$ of the stepdown gear assembly implemented in three portions. Flared axle tubes $Tr_1$ and $Tr_2$ about which the wheels $Ro_1$ and $Ro_2$ rotate are secured in the side casings $Pr_1$ and $Pr_2$. The brake disks $Di_1$ and $Di_2$ are mounted on the wheels $Ro_1$ and $Ro_2$ and they are associated with the brake calipers $Et_1$ and $Et_2$ secured to the side casings $Pr_1$ and $Pr_2$of the assembly. The wheels $Ro_1$ and $Ro_2$ are also associated with the side stepdown gears $Rl_1$ and $Rl_2$ driven by the wheel shafts $Ar_1$ and $Ar_2$.

The entire set of members mentioned above constitutes the basis of the architecture of the motorized axle, which basis is common to the single-motor version and to the two-motor version. The central portion of the stepdown gear assembly constitutes the modular portion PMEM of the motorized axle. The central portion is composed of a casing $Pr_c$:

in which, in the single-motor version, a central mechanical system Mc with a differential is mounted, the two above-mentioned wheel shafts $Ar_1$ and $Ar_2$ leading off from the outlets of this system; and in which, in the two-motor version, two independent central stepdown gears $Rc_1$ and $Rc_2$ are mounted, the two above-mentioned wheel shafts $Ar_1$ and $Ar_2$ leading off from the outlets of these gears.

The motor Mo (single-motor version) and the motors $Mo_1$ and $Mo_2$ (two-motor version) are:

either rigidly mounted on the central casing Prc of the stepdown gear assembly (version having "non-suspended" motors) and connected to the central mechanical system having a differential Mc (single-motor version) or to the central stepdown gears $Rc_1$ and $Rc_2$ (two-motor version) respectively by a link or by two links without relative displacement;

or else connected to the central casing $Pr_c$ of the stepdown gear assembly via a resilient suspension Se (version having "floating" motors) and connected to the central mechanical system having a differential Mc (single-motor version) or to the central stepdown gears $Rc_1$ and $Rc_2$ (two-motor version) respectively via a coupling Ac or via two couplings $Ac_1$ and $Ac_2$ that accommodate the displacements due to the resilient suspension.

I claim:

1. A motorized axle comprising:

an axle assembly, said axle assembly having a first end and a second end, said axle assembly being connected to at least one of a body and a corridor connection of a vehicle;

a central casing integrated with said axle assembly, without an unbalanced overhands, between said first end of said axle assembly and said second end of said axle assembly;

a first wheel mounted with respect to said axle assembly;

a second wheel mounted with respect to said axle assembly so that said first wheel rotates independently of said second wheel;

at least one motor, said at least one motor being connected to said central casing; and at least one stepdown gear assembly, said at least one stepdown gear assembly linked with said at least one motor.

2. A motorized axle according to claim 1, further comprising:

a first wheel shaft having a first end and a second end;

said axle assembly surrounding said first wheel shaft where said first end of said first wheel shaft protrudes through said first end of said axle assembly, and said second end of said first wheel shaft is connected to said at least one stepdown gear assembly;

a second wheel shaft having a first end and a second end;

said axle assembly surrounding said second wheel shaft where said first end of said second wheel shaft protrudes through said second end of said axle assembly, and said second end of said second wheel shaft is connected to said at least one stepdown gear assembly;

said first wheel connected to said first end of said first wheel shaft;

said second wheel connected to said first end of said second wheel shaft so that said second wheel rotates independently of said first wheel.

3. A motorized axle according to claim 2, wherein said first wheel shaft is linked to said at least one stepdown gear so as to transmit motion and torque between said at least one motor and said first wheel, a rotational output axis of said at least one motor being parallel to a rotational axis of said first wheel; and said second wheel shaft linked to said at least one stepdown gear so as to transmit motion and torque between said at least one motor and said second wheel, the axis of said at least one motor being parallel to the axis of said second wheel.

4. A motorized axle according to claim 2, wherein said connection between said first wheel shaft and said at least one stepdown gear assembly is implemented by said at least one stepdown gear assembly having a conical epicyclic gear train.

5. A motorized axle according to claim 2, further comprising:

brakes, said brakes provided by disks on at least one of said first wheel shaft and said second wheel shaft.

6. A motorized axle according to claim 5, wherein said brakes are in two portions to facilitate removal.

7. A motorized axle according to claim 5, wherein said brakes are disposed between said first wheel and said second wheel making it possible to remove tires without removing other members.

8. A motorized axle according to claim 1, further comprising a load bearing cross member disposed between said axle assembly and said at least one of the body and the corridor connection of the vehicle.

9. A motorized axle according to claim 8, wherein said suspension system of said axle assembly can accommodate angular displacement relative to said at least one of the body and the corridor connection of the vehicle, making it possible to omit said load bearing cross member and a ball bearing ring.

10. A motorized axle according to claim 1, further comprising a suspension system disposed between said axle assembly and said at least one of the body and the corridor connection of the vehicle.

11. A motorized axle according to claim 10, wherein said suspension system of said axle assembly is implemented by a single stage only by means of two pneumatic cushions.

12. A motorized axle according to claim 10, wherein said suspension system of said axle assembly is implemented by a single stage only by means of metal springs.

13. A motorized axle according to claim 10, wherein said suspension system of said axle assembly is implemented by a single stage only by means of rubber-metal springs.

14. A motorized axle according to claim 10, wherein said suspension system is disposed between said first wheel and said second wheel making it possible to remove tires without removing other members.

15. A motorized axle according to claim 1, wherein said at least one motor is rigidly connected to said central casing.

16. A motorized axle according to claim 1, further comprising a resilient suspension interposed between said at least one motor and said central casing.

17. A motorized axle according to claim 16, further comprising a coupling device for accommodating a displacement due to said resilient suspension, said coupling device being interposed between said at least one motor and said at least one stepdown gear assembly.

18. A motorized axle according to claim 1, such that said link between said at least one motor and said at least one stepdown gear assembly has no relative displacement.

19. A motorized axle according to claim 1, further comprising a first of said at least one stepdown gear assembly and a second of said at least one stepdown gear assembly.

20. A motorized axle according to claim 1, wherein said at least one stepdown gear is located inside said central casing.

21. A motorized axle according to claim 1, further comprising a first of said at least one motor and a second of said at least one motor.

22. A motorized axle according to claim 21, further comprising a first of said at least one stepdown gear assembly and a second of said at least one stepdown gear assembly.

23. A motorized axle according to claim 22, wherein said first of said at least one motor is linked to said first of said at least one stepdown gear and said second of said at least one motor is linked to said second of said at least one stepdown gear.

24. A motorized axle according to claim 23, wherein said link between said first of said at least one motor and said first of said at least one stepdown gear has no relative displacement, and said link between said second of said at least one motor and said second of said at least one stepdown gear has no relative displacement.

25. A motorized axle according to claim 23 wherein said first of said at least one motor is connected to said central casing and said second of said at least one motor is connected to said central casing.

26. A motorized axle according to claim 25, further comprising a resilient suspension interposed between said first of said at least one motor and said central casing and between said second of said at least one motor and said central casing.

27. A motorized axle according to claim 26, further comprising a first coupling device and a second coupling device for accommodating a displacement due to said resilient suspension, said first coupling device being interposed between said first of said at least one motor and said first of said at least one stepdown gear and said second coupling device being interposed between said second of said at least one motor and said second of said at least one stepdown gear.

28. A motorized axle comprising:

an axle assembly, said axle assembly having a first end and a second end, said axle assembly being connected to at least one of a body and a corridor connection of a vehicle;

a central casing located between said first end of said axle assembly and said second end of said axle assembly;

a first wheel mounted with respect to said axle assembly;

a second wheel mounted with respect to said axle assembly so that said first wheel rotates independently of said second wheel;

at least one motor, said at least one motor being connected to said central casing; and at least one stepdown gear assembly, said at least one stepdown gear assembly linked with said at least one motor, said motorized axle further comprising:

a first wheel shaft having a first end and a second ends wherein said first wheel shaft is linked to said at least one stepdown gear so as to transmit motion and torque between said at least one motor and said first wheel, a rotational output axis of said at least one motor being parallel to a rotational axis of said first wheel;

said axle assembly surrounding said first wheel shaft where said first end of said first wheel shaft protrudes through said first end of said axle assembly, and said second end of said first wheel shaft is connected to said at least one stepdown gear assembly;

a second wheel shaft having a first end and a second ends wherein said second wheel shaft linked to said at least one stepdown gear so as to transmit motion and torque between said at least one motor and said second wheel, the axis of said at least one motor being parallel to the axis of said second wheel;

said axle assembly surrounding said second wheel shaft where said first end of said second wheel shaft protrudes through said second end of said axle assembly, and said second end of said second wheel shaft is connected to said at least one stepdown gear assembly;

said first wheel connected to said first end of said first wheel shaft; and said second wheel connected to said first end of said second wheel shaft so that said second wheel rotates independently of said first wheel.

29. A motorized axle comprising:

an axle assembly, said axle assembly having a first end and a second end, said axle assembly being connected to at least one of a body and a corridor connection of a vehicle;

a central casing located between said first end of said axle assembly and said second end of said axle assembly;

a first wheel mounted with respect to said axle assembly;

a second wheel mounted with respect to said axle assembly so that said first wheel rotates independently of said second wheel;

at least one motor, said at least one motor being connected to said central casing; and at least one stepdown gear assembly, said at least one stepdown gear assembly linked with said at least one motor such that said link between said at least one motor and said at least one stepdown gear assembly has no relative displacement.

* * * * *